United States Patent [19]

Pfeiffer

[11] Patent Number: 4,688,854

[45] Date of Patent: Aug. 25, 1987

[54] APPARATUS FOR MAKING SMALL-BORE TUNNELS

[75] Inventor: Ludwig Pfeiffer, Kassel, Fed. Rep. of Germany

[73] Assignee: MTS Minitunnelsysteme GmbH, Kassel, Fed. Rep. of Germany

[21] Appl. No.: 749,802

[22] Filed: Jun. 28, 1985

[30] Foreign Application Priority Data

Jun. 28, 1984 [DE] Fed. Rep. of Germany ..... 3423842

[51] Int. Cl.[4] ..... E21D 9/10

[52] U.S. Cl. ..... 299/33; 299/73

[58] Field of Search ..... 299/11, 33, 73, 75, 299/76; 175/94, 101, 106, 62, 203, 26; 173/22, 23; 279/30

[56] References Cited

U.S. PATENT DOCUMENTS 4,232,905 11/1980 Dick ..... 299/73

FOREIGN PATENT DOCUMENTS 3222380 9/1983 Fed. Rep. of Germany .
3249087 12/1983 Fed. Rep. of Germany .
1180910 11/1970 United Kingdom .
1472590 5/1977 United Kingdom .

OTHER PUBLICATIONS

TIS (Tiefbau, Ingenieurbar, Strassenbau) Aug. 1981, pp. 550–555; G. Hurtz and W. Weber.
TIS (Tiefbau, Ingenieurbau, Strassenbau) Feb. 1983, pp. 58–61; W. Weber and H. P. Uffmann.
TIS (Tiefbau, Ingenieurbau, Strassenbau) Mar. 1983, pp. 109–112 and 121; W. Weber and H. P. Uffmann.

*Primary Examiner*—Stephen J. Novosad
*Assistant Examiner*—Thomas J. Odar

[57] ABSTRACT

The invention relates to an apparatus for making small-bore underground tunnels. It contains a working tube which can be advanced in the direction of the developing tunnel, and an excavating unit mounted in the working tube and having an excavating tool. The excavating unit is displaceable in the working tube. The excavating tool has a substantially smaller effective outside cross section than corresponds to the internal cross section of the working tube, and is mounted on the excavating unit so as to be displaceable in directions perpendicular to the working tube axis. Drive means serve for moving the excavating tube within a range of action whose maximum cross section, measured perpendicular to the working tube axis, corresponds at least to the outside cross section of the working tube.

8 Claims, 5 Drawing Figures

APPARATUS FOR MAKING SMALL-BORE TUNNELS

The invention relates to an apparatus for making small-bore tunnels underground, which has a work tube which can be advanced in the tunneling direction.

In structural work below ground level it is common practice to create underground conduits for supplying water, gas and heat or the like, by tunneling close to the surface and shoring up the tunnels with pipes driven into them. Since workers cannot crawl through the tunnels and therefore there is no possibility of having the tunneling tool controlled by an operator situated directly at the working face, apparatus of the kind described above have been developed which work through the ground independently, i.e., unaccompanied by an operator. The operating personnel are needed only for the purpose of feeding the working tube from a pit at the entrance to the tunnel in the direction of the tunnel being bored, and, if necessary, of joining additional shoring tubes to the working tube (Wirth, Technical Description of the HB 700 Model 1 Tube Driving System.)

The commonly used tunneling apparatus lead to a number of problems, especially when soil conditions vary. The easy deformation of the working tubes when they encounter underground obstructions, the need to discontinue tunneling as result of obstructions in the form of rocks and of remmants of timbering and foundations or the like, and the deviation of the tunnels from their intended direction due to differences in soil strata, are but examples of such problems.

The problems described are mainly a result of the fact that the known tunneling apparatus are provided with an excavating tool whose effective outside cross section corresponds at least to the inside cross section of the working tube placed in the tunnel, so that cutting takes place over the entire working face. When soil conditions at the working face are uniform, this is no problem, because the forces produced at the rotationally symmetrical tunneling tools cancel one another. If the soil conditions are not uniform, however, the forces at the cutters or chisels of the tunneling tool differ, so that a resultant force is produced on the tool which seeks to displace it toward the soil layer of least compressive strength, and thus causes a deflection of the longitudinal axis of the working tube from the desired axis of the tunnel. To avoid this disadvantage, it is known to mount the tunneling unit on a tube section that is articulated to the working tube. This makes it possible to pass around any obstructions and, after by-passing them, to return to the desired alignment of the tunnel by steering this tube section. Even with apparatus of this kind, however, it is impossible to remove obstructions and drill the tunnel all the way without deflection from the desired alignment.

For the reliable loosening of the material at the working face, considerable torque has to be applied when using the known apparatus. The maximum achievable torques, however, are limited by the dimensions of the drives that can be contained in the tube cross section, so that the forces available at the working face per unit of area are undesirably small. Furthermore, the known apparatus are provided with a fixedly mounted cutting tool which cannot easily be adapted to varying soil conditions or be replaced in case it is worn or damaged. Lastly, there is difficulty in the removal of the spoil, which can be carried away only through openings in the tunneling tool and are impassible for larger rocks, boulders or the like, which remain in front of the tunneling tool, jam it up, and make further tunneling impossible. The known apparatus are therefore usable to advantage only in soft, aquiferous layers of soil.

For the production of tunnels of larger cross section, such as subway tubes and railroad tunnels, apparatus are known which have excavating tools whose effective outside cross sections are substantially smaller than the internal cross section of the working tube, and which can be swung about, perpendicularly to the longitudinal axis of the working tube, within range of action that is at least equl to the outside cross section of the working tube (German Federal AS No. 1 658 753). In the use of such apparatus it is common practice to man the excavating unit, i.e., to have it controlled by an operator who is present at the working face. Automatic control is possible, but aside from the automation effect it offers no special advantages. In the digging of narrow-bore tunnels, however, semiautomatic or fully automatic control is essential, because it is impossible to operate the excavating tool and the rest of the functions in a sufficiently reliable manner from a pit often several hundred meters away from it. For this reason, the apparatus known for the production of tunnels of larger cross section cannot be applied analogously to the production of small-bore, humanly inaccessible tunnels.

The invention is addressed to the problem of improving the apparatus described above for the production of small-bore tunnels such that it will be suitable also for tunneling through inhomogeneous layers of soil containing obstructions, such that large forces per unit of surface area will be able to be applied without thereby deflecting the longitudinal axis of the working tube from the desired alignment, and such as to permit easy replacement of the tunneling tool. In particular, an apparatus is to be created which will have a tunneling unit which can be backed out of the working tube.

For the solution of this problem, an apparatus for the production of underground, humanly inaccessible small-bore tunnels is provided, which contains: a working tube which can be advanced in the direction of the tunnel and has a longitudinal axis, an outside cross section, an inside cross section, a front end and a rear end; a frame which is mounted for displacement in the working tube parallel to its longitudinal axis and can be removed through the rear end of the working tube; and excavating unit disposed in the working tube and mounted on the frame, and having an excavating tool and an excavating head bearing the latter, the excavating tool and the excavating head having a substantially smaller effective cross section that corresponds to the inside cross section of the working tube; means for displacing the excavating tool parallel to the longitudinal axis of the working tube and for expelling or retracting the excavating tube through the front end of the working tube; and means for moving the excavating tool perpendicular to the longitudinal axis of the working tube within a range of action that is at least equal to the outside cross section of the working tube.

The invention offers a number of advantages. On the basis of the use of an excavating tool whose outside cross section is smaller than the inside cross section of the working tube and hence also the cross section of the tunnel being produced, large forces per unit of area can be applied with comparatively small drives. By the controlled movement of the excavating tool it is possible gradually to increase the cross section of the tunnel and remove obstacles without causing the resultant forces exerted on the excavating tool to exceed a level which is critical with regard to deviation from the desired direction. Lastly, it is easily possible to replace the excavating tool, since for this purpose it is necessary only to move the entire excavating unit to the end of the working tube remote from the working face and from there to transport it by means of rail systems or the like through the tube sections that may be following the working tube, to the access pit from which the tunnel was started.

The invention will be further explained hereinbelow with the aid of an embodiment, in conjunction with the appended drawing, wherein.

Figure 1:
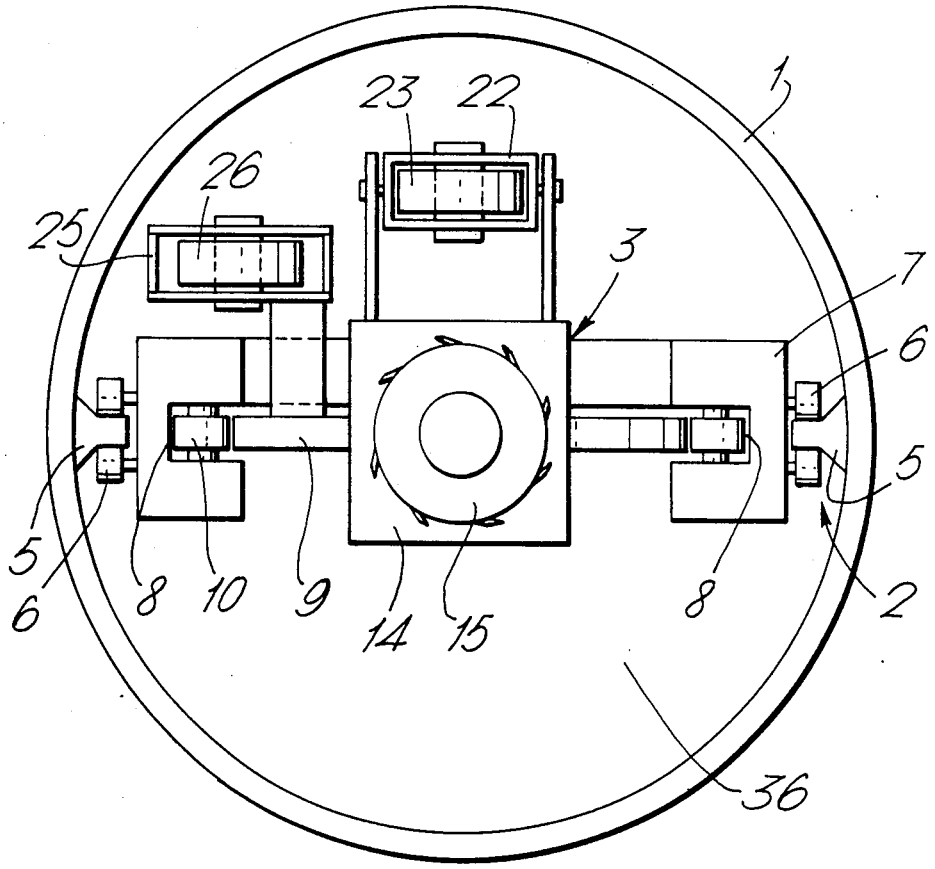
FIG. 1 is a front elevational view of the apparatus of the invention.
Figure 2:
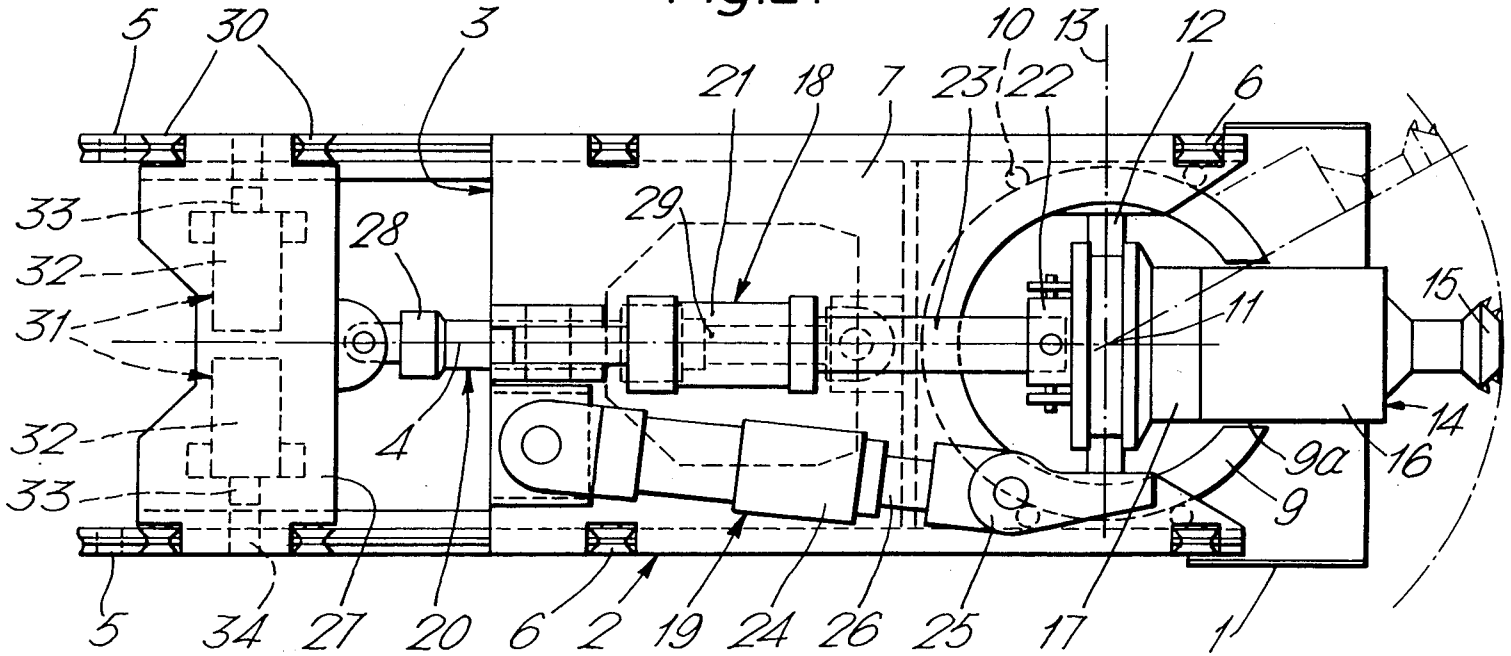
FIG. 2 is a top view of the apparatus of FIG. 1 in a retracted position of the frame of the apparatus.
Figure 2A:
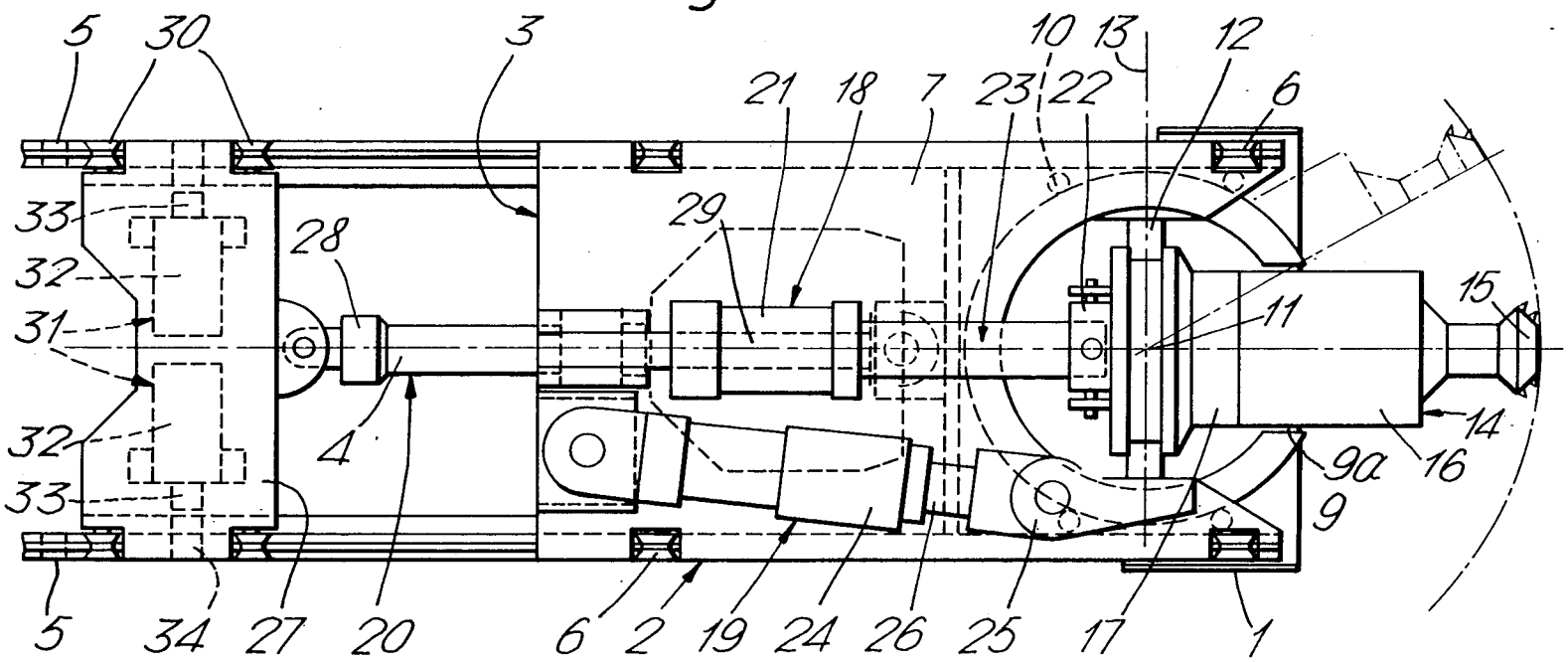
Figure 3:
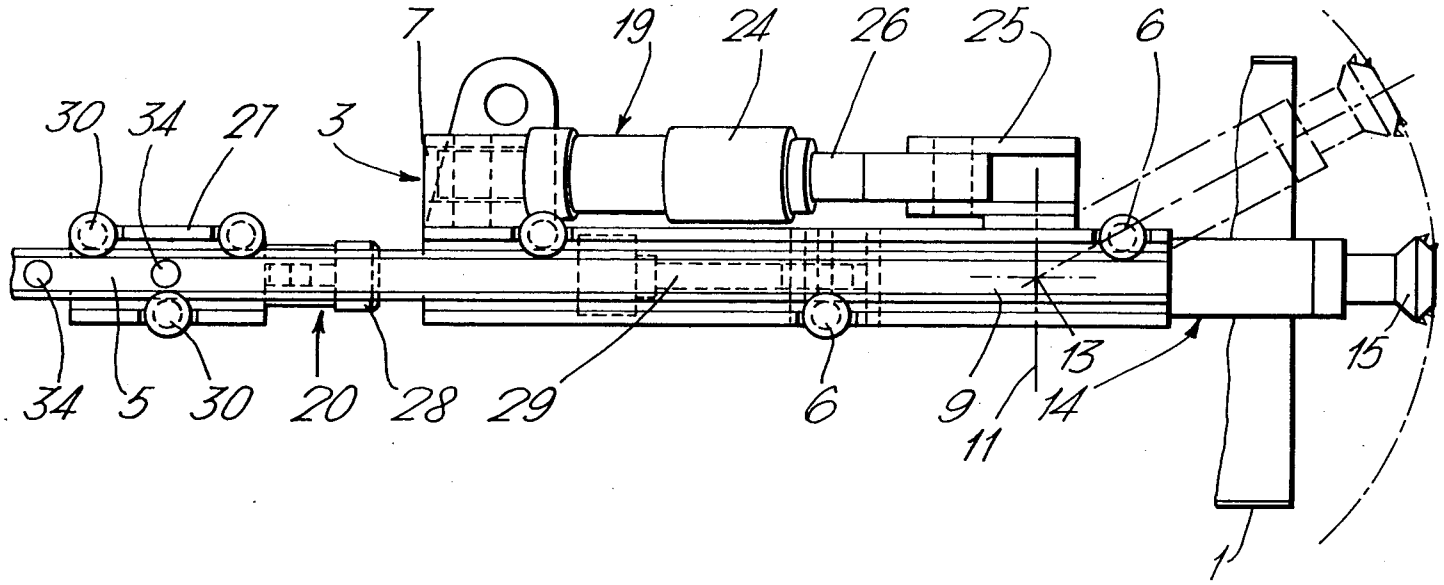
Figure 3A:
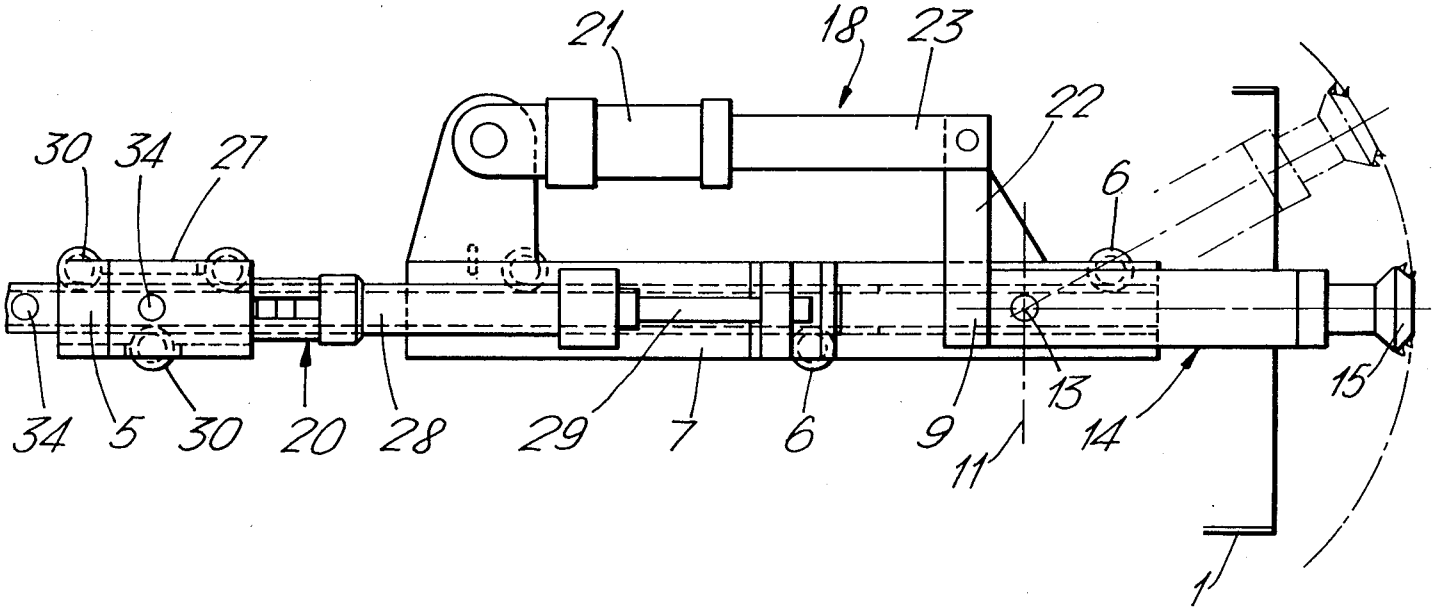

"FIG. 2*a* shows the apparatus of FIG. 2 in an advanced position of the frame;

FIG. 3 is a side view of the apparatus of FIG. 1; and

"FIG. 3 is another side view of the apparatus of FIG. 1."

In FIGS. 1 to 3, the apparatus of the invention contains a working tube 1, consisting of steel for example, and having a rail system 2 fastened therein whereby an excavating unit 3 can rode back and forth in the working tube parallel to the longitudinal axis 4 thereof. The rail system 2 contains two diametrically opposite rails 5 disposed parallel to one another and to the axis 4 of the working tube, these rails being fastened to the inside wall of the working tube 1. On both sides of these rails 5 run a plurality of wheels 6 of a frame 7 in which the excavating unit 3 is mounted, and which has a U-shaped recess 8 facing the longitudinal axis 4 in the area of each of the two rails 5. These recesses 8 straddle, at two diametrically opposite sides, a turning ring 9 having a cylindrical periphery which is rotatably supported by means of wheels 10 in the recesses 8 of the frame 7 and has at its front end a radial recess 9*a*. The axis of rotation 11 of the turning ring 9 intersects the axis 4 of the working tube 1 at a right angle.

As indicated in FIG. 2, the turning ring 9 has a gap 9a and is provided with two pivots 12 whose common pivot axis 13 passes through the intersection of the axes 4 and 11 and is perpendicular both to the axis 4 and to the axis of rotation 11. The pivots 12 serve for the pivotal mounting of an excavating head 14 which extends radially through the gap 9a and bears on its front end an excavating tool 15, which consists for example of a cutterhead which can rotate at high speed and whose outside diameter is substantially smaller, preferably at least smaller by half than the inside diameter of the working tube 1. The excavating tool 15 is fastened for easy replacement by means of a quick-acting collet chuck on the excavating head 14 which consists essentially of a drive casing 16, a drive motor 17—for example a hydraulic motor—flange-mounted on the casing, and a gear drive disposed in the drive casing 16.

The excavating head 14 is furthermore rotatable in the one sense by means of the turning ring 9 about the pivot axis 11, which hereinafter will be considered as the Y-axis of an imaginary coordinate system, and in another sense it is rotatable on the pivot 12 about the pivot axis 13 considered hereinafter as the X-axis of the imaginary coordinate system. At the same time the excavating unit is displaceable by means of the rail system 2 in the direction of the axis 4 corresponding to the Z-axis of the imaginery coordinate system. Consequently, the excavating tool 15, which extends sufficiently far beyond the front end of the excavating unit 14 and has its own axis of rotation, is able to move on any of these three axes, i.e., in the X, Y and Z directions, within a range of action whose maximum cross section corresponds at least to the outside cross section of the working tube 1. In the present embodiment, the rearward prolongation of the axis of rotation of the excavating tool 15 always runs through the intersection of the three axes 4, 11 and 13.

These movements of the excavating tool 15 are produced by a control apparatus having three separately controllable drives, preferably in the form of cylinder-and-piston systems 18, 19 and 20. The cylinder-and-piston system 18 has a cylinder 21 articulated on the frame 7 and a piston rod 23 articulated to a bearing 22 on the excavating head 14, and it serves the purpose of turning the excavating head 14 about the pivot axis 13 corresponding to a movement of the excavating tool 15 in the Y direction. The cylinder-and-piston system 19 has a cylinder 24 also articulated to the frame 7, and a piston rod 26 articulated to a bearing 25 on the turning ring 9, and serves for the rotation of the turning ring 9 corresponding to a turning of the excavating head 14 fastened thereon about the pivot axis 11 and thus it serves to produce a movement of the excavating tool 15 in the X direction.

Lastly, the cylinder-and-piston system 20 has a cylinder 28 articulated to a carriage 27 and a piston rod 29, and serves for moving the frame 7 and excavating unit 3 in the direction of the longitudinal axis 4 and hence for moving the excavating tool 15 in the Z direction. At the same time all cylinders and piston rods are articulated to their associated components such that all fo the turning and rotating movements can be performed singly or in any combination.

Like the frame 7, the carriage is mounted for displacement on wheels 30 running on rails 5. It is furthermore provided with a locking system whereby it can be locked up against displacement in the working tube 1. The locking system comprises for example two cylinder-and-piston systems 31 with cylinders 32 mounted on the carriage 27, and piston rods 33 disposed perpendicular to the working tube axis 4 which can be forced clampingly against the inside wall of the working tube 1 or of the rails 5 in order to lock the carriage 7 at any desired point along the axis 4. Alternatively, recesses 34 can be formed at preselected intervals in the rails 5 and the outer ends of the piston rods 33 or pins affixed thereto can be introducible into these recesses for the purpose of locking the carriage positively rather than frictionally at given points along the axis 4.

The removal of the material excavated by the tool 15 from the working face is accomplished by a preferably mechanical conveyor means best disposed in a space 35 (FIG. 1) beneath the turning ring 9 and the entire excavating unit 3. It can contain, for example, a shovel movable by means of chains, a conveyor belt, or a push-rod system having a plurality of swinging flaps arranged at intervals, each flap transferring the spoil to the next flap in a step-wise manner. The conveying is performed in this case parallel to the working tube axis 4, such that the actual conveyor means can be brought up approximately to the front end of the working tube and thus all the way to the working face, in order to gather the loosened and falling material. Owing to the fact that the excavating tool 15 and also the excavating head 14 have a sufficiently small effective external cross section in comparison to the inside cross section of the working tube 1, conveyor means of this kind can easily be situated in the space 36.

The apparatus of the invention operates in the following manner:

First pits are dug at both ends of the proposed underground tunnel. In one pit the working tube 1 is positioned such that its front end is applied to the wall of the pit, the axis 4 is aligned with the axis of the proposed tunnel, and the two rails are disposed at the same height so that they form with axis 4 a horizontal plane dividing the working tube into upper and lower halves. Furthermore, the arrangement is made such that the excavating unit is situated substantially above this plane, but the conveyor system is situated substantially below this plane. Lastly, the axis of rotation of the excavating tool 15 is best set coaxially with the axis 4 at this time.

The carriage 27 is now locked in the working tube 1 by means of the cylinder-and-piston system 31, so that it forms a support for the displacement of frame 7 in direction Z. The frame 7 is advanced by the actuation of the cylinder-and-piston system 20, in order to advance the excavating tool 15 through the front end of the working tube against the wall that is to be bored, i.e., the working face. The boring is started by turning on the motor 17. The excavating tool 15 is, for example, a revolving cutterhead which loosens the material within its range of action. By the appropriate control of the cylinder-and-piston systems 18, 19 and 20, the excavating tool 15 is then moved in directions X, Y and Z such that is gradually produces a bore of constantly increasing cross section. It is desirable first to make the excavating tool move on surfaces with gradually increasing radii with respect to the longitudinal axis by the operation of the cylinder-and-piston systems 18 and 19, and at the same time to block it in the Z direction by means of the frame 7 and the cylinder-and-piston system 20 and carrige 27, until a bore cross section is achieved that is identical to the outside cross section of the working tube 1, then to advance it slightly in the Z direction and then repeat the boring process.

The bore cross sections created by the excavating tool 15 and extending in the Z direction must be shored up by tubing. This is accomplished by advancing the working tube 1 from the pit by means of a hydraulic jack or the like as far as the bore will permit. When the working tube 1 disappears completely into the bore, additional tubes are driven into the portion of the bore left fre in back of the working tube. Before this is done, the excavating tool 15 is retracted into the working tube 1 by means of the cylinder-and-piston system 20. If it is desired to position the carriage 27 at a different point within the working tube 1, it is necessary only to release the locking system associated with it and to operate the cylinder-and-piston system 20 accordingly, since in this case the comparatively heavy excavating unit 3 remains at a standstill. Alternatively it would be possible to associate a locking system also with the excavating unit 3.

During the boring process or also in the pauses between successive boring actions, it is necessary to remove the from the working face the loosened material which collects partially on the bottom of the working tube 1 and partially on the bottom of the tunnel and would make it impossible to continue excavation. For this purpose the automatic conveyor system is started up, which picks up the loosened material and transports it underneath the excavating unit 3 through to the other end of the working tube 1. In back of the excavating unit 3 or the rear end of the working tube 1, the material can be transferred directly onto a conveyor belt situated in the head pit.

The range of action of the conveyor system extends preferably only over the length of the working tube 1 so that it can be advanced together with the latter. Therefore, after the working tube has disappeared into the tunnel, other apparatus are needed in order to take over the maaterial transported to the back end of the working tube by the conveyor system and carry it on to the head pit. For this purpose provision can be made, for example, for providing the tubes following the working tube with rails for a shuttle car.

It is desirable to supervise the operation of the excavating tool 15 by means of a television camera or the like mounted on the excavating unit 3. When an obstruction is encountered, the nature and position of the obstacle can be precisely determined by means of the television camera and and excavating tool 15 can be operated through the control system such as to gradually eliminatae the obstruction. On account of the small size of the excavating tool, it is possible always to angle the excavating tool favorably in relation to the obstacle and prevent the exercise on the working tube 1 of forces so great that the latter is deflected from its intended course. In addition to this, the desired direction of advancement of the working tube can be maintained very precisely, for example by using a laser beam to establish the proper axis for the tunnel and control the movement of the excavating tool with respect to this axis. Since in this case the axes of the tunnel sections successively produced by the excavating tool are in each case centered by the laser beams, deviation of the actual tunnel axis from the required axis is virtually impossible.

If it is desired to change the excavating tool 15, whether due to wear or to a change in the soil strata, the entire excavating unit 3 is shifted by means of the cylinder-and-piston system 20 all the way to the rear end of the working tube, where it is hitched to a car or the like which is driven into the tubes following the working tube and from there into the head pit. Alternatively it would be possible to provide the tubes following the working tube with rail systems corresponding to rail system 2 and to transport the excavating unit to the head pit only by actuating the cylinder-and-piston system 20 accordingly. If an especially critical obstacle is encountered which cannot be removed with ordinary excavating tools, it would be conceivable even to provide the excavating unit with a compressed-air jackhammer or with an explosive charge. All of these measures can be applied under observation through the television camera and without requiring workers to enter the tunnel.

The invention is not restricted to the embodiment described, which can be modified in many ways. This is true especially of the conveyor system, of the transport means required for the replacement of the excavating tool, and of the hydraulic or pneumatic cylinder-and-piston systems, but also of the manner in which the excavating tool 15 is moved within its range of action. It would be possible, for example, to move the excavating tool linearly in the X and Y directions, or to move them by means of parallelogram-like guides or articulations, instead of producing the movements in these directions by rotatory or swinging movements. In addition thereto, the control apparatus can be designed in any desired manner and can be provided with automatically operating computers or microprocessors for the computation of the movements of the excavating tool. It would also be possible to omit the rail system 2 and mount the frame 7 and the carriage 27 in some other manner for displacement int he working tube 1, for example by means of sliding or rolling guides.

I claim:

1. An apparatus for making an underground tunnel having a maximum diameter of about 80 centimeters, said apparatus comprising: a working tube for being pressed and advanced in the direction of the tunnel to be made by acting on a rear end thereof, and having a longitudinal axis, an outside cross section, an inside cross section and a front end; a frame; means for coupling said frame to said working tube such that it can selectively be held within and advanced together with the working tube or displaced parallel to the longitudinal axis thereof; means for uncoupling said frame from said working tube such that it can be removed through the rear end of the working tube; an excavating unit disposed within said working tube and mounted on said frame, said excavaating unit having an excavating head and an excavating tool rotatably carried by said head, said tool having an active cross section substantially smaller than the inside diameter of said working tube; means for displacing the excavating tool parallel to the longitudinal axis of the working tube; means for rotating said tool; and means for moving the excavating tool during rotation thereof in directions transverse to said longitudinal axis within a range of action having a cross section which is at least equal to the outside cross section of said working tube.

2. An apparatus according to claim 1, comprising a rail system running parallel to said longitudinal axis of said working tube inside said tube, the frame being displaceably mounted on said rail system.

3. An apparatus according to claim 1, comprising means for moving said excavating head around a first axis perpendicular to the longitudinal axis of said tube, and comparing means for moving said excavating head around a second axis perpendicular to said first axis and perpendicular to said longitudinal axis.

4. An apparatus according to claim 3, wherein said frame has a turning ring having a gap and being mounted for rotation about said first axis, and means for mounting said excavating head in said turning ring and in said gap for rotation about said second axis.

5. An apparatus according to claim 4, wherein said means for moving the excavating tool in directions transverse to the longitudinal axis comprises a cylinder-and-piston system for rotating said turning ring, and a cylinder-and piston system for swinging the excavation head within the turning ring.

6. An apparatus according to claim 5, wherein said cylinder-and-piston system for swinging the excavating head is articulated to the frame and to the excavating head.

7. An apparatus according to claim 5, wherein said cylinder-and-piston system for turning said turning ring is articulated to the frame and to the turning ring.

8. An apparatus according to claim 1, said coupling means comprising a carriage mounted within said working tube and behind said frame, and wherein a cylinder-and-piston unit is provided for displacing said frame parallel to said longitudinal axis and for coupling said frame to said carriage, and mens for locking said carriage to said working tube such that the carriage can be advanced therewith, and for unlocking said carriage from said working tube such that the carriage may be removed together with said frame through the rear end of the working tube.

* * * * *